US005771860A

United States Patent [19]

Bernardi

[11] Patent Number: 5,771,860

[45] Date of Patent: Jun. 30, 1998

[54] AUTOMATIC POWER BALANCING APPARATUS FOR TANDEM ENGINES AND METHOD OF OPERATING SAME

[75] Inventor: John J. Bernardi, Chillicothe, Ill.

[73] Assignee: Caterpillar Inc., Peoria, Ill.

[21] Appl. No.: 837,728

[22] Filed: Apr. 22, 1997

[51] Int. Cl.[6] ..... F02D 31/00; F02D 25/00

[52] U.S. Cl. ..... 123/352; 123/DIG. 8; 60/710

[58] Field of Search ..... 123/352, 361, 123/DIG. 8; 60/710, 711

[56] References Cited

U.S. PATENT DOCUMENTS

| | | | |
|---|---|---|---|
| 2,452,064 | 10/1948 | Mayrath | 60/710 |
| 4,004,648 | 1/1977 | Joseph et al. | 180/105 R |
| 4,137,721 | 2/1979 | Glennon et al. | 60/711 |
| 4,147,035 | 4/1979 | Moore et al. | 60/711 |
| 4,277,945 | 7/1981 | Esthimer et al. | 60/710 |
| 4,702,082 | 10/1987 | Kobelt | 60/710 |
| 4,934,825 | 6/1990 | Martin | 364/431.01 |
| 4,964,276 | 10/1990 | Sturdy | 60/700 |
| 5,447,132 | 9/1995 | Shoda et al. | 123/357 |

*Primary Examiner*—Raymond A. Nelli
*Assistant Examiner*—Hieu T. Vo
*Attorney, Agent, or Firm*—R. Carl Wilbur

[57] ABSTRACT

A power balancing control to balance power output from a first and second engine that mutually drive a load is disclosed. The control includes an electronic control module electrically connected to a control panel. A first and second inlet manifold pressure sensor are associated with the first and second engine, respectively. An offset potentiometer is connected to the control panel. The control automatically adjusts power output of the second engine in response to the inlet manifold pressure of said first engine, the inlet manifold pressure of said second engine, and a signal produced by said offset potentiometer.

6 Claims, 4 Drawing Sheets

AUTOMATIC POWER BALANCING APPARATUS FOR TANDEM ENGINES AND METHOD OF OPERATING SAME

TECHNICAL FIELD

The present invention relates generally to first and second engines that are arranged mutually to drive a load, and more particularly to power balancing between the engines.

BACKGROUND ART

In some engine applications, the power output required to drive a load exceeds the capability of a single engine of the desired size. One such situation, for example, has been in the field of generator sets ("gen-sets"). Gen-sets typically include an internal combustion engine that is attached to a generator through a shaft. The engine drives the shaft, which in turn drives the generator to produce electrical power. The electrical power output of the generator is a function of the mechanical power input to the generator. Thus, the engine driving the generator can only produce a maximum electrical power output level from the generator corresponding roughly to the maximum mechanical power output of the engine. If the electrical power output required from the gen-set exceeds that maximum level then a more powerful engine is required, or in some instances, it is possible to connect two engines together.

Typically, applications where two engines are tied to a single generator are referred to as tandem engine gen-sets. In such applications, the crankshaft of the first engine is mechanically connected to the crankshaft of the second engine and the crankshaft of the second engine is mechanically connected to the load (in this case the generator). Controlling the power output of the first and second engines is very important in order to obtain maximum electrical power output from the get-set. When operating at full load, the power should be balanced between the first and the second engines.

Prior art systems designed to synchronize the power output levels of the first and second engines typically involve a simple control that produces a single throttle actuator signal. That throttle actuator signal is developed by first designating a master engine. The master engine is then provided with a closed loop engine speed controller, which produces a throttle actuator signal based on an engine speed error calculation. The throttle actuator signal controls the opening and closing of the throttle plate, which in turn controls the amount of air and fuel introduced into the engine cylinders and tends to increase the engine speed. In prior art systems, the throttle actuator signal is simply used to control the throttle plate position on both the master and the slave engines.

While such systems generally perform adequately, they operate as a pseudo open loop control requiring a close mapping between throttle plate position and the corresponding power output. However, since throttle plate position is only one factor in determining the power output of an engine, such systems sometimes produce less than desirable results. Also, manufacturing tolerances may cause the same model engine to produce slightly different output power at the same throttle positions. Furthermore, changes in the engine performance over time can cause engines that initially had identical power outputs for the same throttle position thereafter to change.

In light of these shortcomings and drawbacks associated with the prior art, it is therefore an object of the present invention to more accurately control and synchronize the power outputs of a first and second engine. Other objects and advantages associated with the present invention will become apparent upon reading the detailed description of a preferred embodiment in conjunction with the drawings and the appended claims.

DISCLOSURE OF THE INVENTION

A power balancing control to balance power output from a first and second engine that mutually drive a load is disclosed. The control includes an electronic control module electrically connected to a control panel. A first and second inlet manifold pressure sensor are associated with the first and second engine, respectively. An offset potentiometer is connected to the control panel. The control automatically adjusts power output of the second engine in response to the inlet manifold pressure of said first engine, the inlet manifold pressure of said second engine, and a signal produced by said offset potentiometer.

DETAILED DESCRIPTION OF THE BEST MODE EMBODIMENT OF THE INVENTION

The following is a detailed description of the best mode embodiment of the invention. The best mode described herein does not define the scope of the present invention. To the contrary, other equivalent or alternative embodiments may nevertheless fall within the scope of the present invention as defined by the appended claims.

Figure 1:
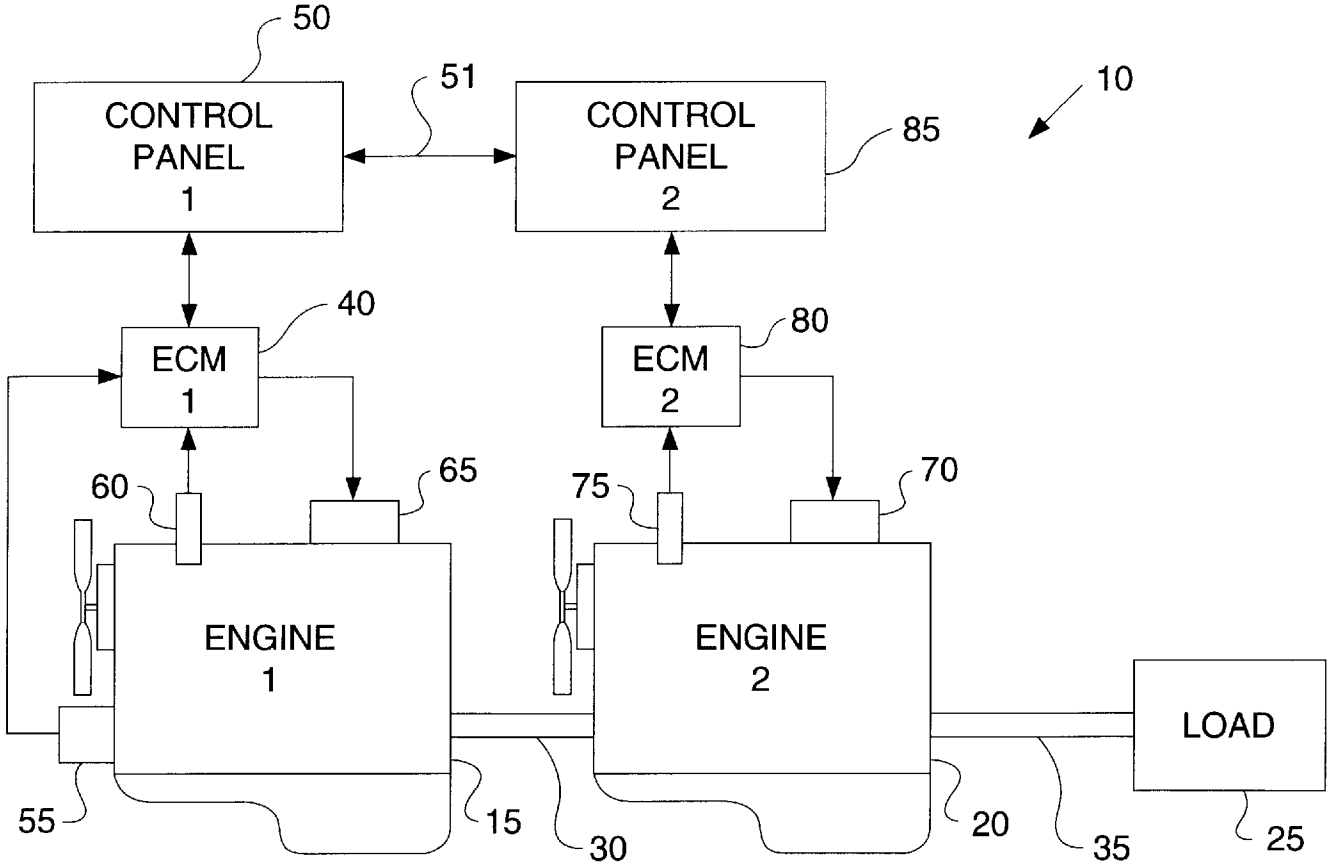
FIG. 1 shows a preferred embodiment of the invention in block diagram form.

Referring first to FIG. 1, a system level block diagram 10 of the best mode embodiment of the control of the present invention is shown in connection with a first engine 15, a second engine 20 and a load 25. In a preferred embodiment the load 25 is typically a generator that generates electrical power in response to a mechanical power input. As shown in FIG. 1, the first engine 15 is typically connected by a shaft 30 or other mechanical device to transmit mechanical power to the second engine 20 which is connected by a shaft 35 or other mechanical device to transmit power to the load 25. The shafts 30,35 transmit power produced by the first engine 15 and the second engine 20 to rotate or otherwise move the load 25.

An engine speed sensor 55 is connected to the first engine 15 and produces a signal indicative of the rotational speed of the engine. In a preferred embodiment, the engine speed sensor 55 is a magneto reluctance type sensor that senses the rotational speed of a specific tooth or teeth on the crankshaft or the camshaft. Such devices are well known in the art. Although the present invention uses a magneto reluctance device, other types of speed sensors are known which could be readily and easily used without deviating from the scope of the present invention as defined by the appended claims.

Also connected to the first engine 15 is a first inlet manifold pressure sensor 60 which produces a signal indicative of the inlet manifold air pressure of the first engine 15. Placement of the inlet manifold pressure sensor 60 is important to proper functioning of the present invention. Since inlet manifold pressure will be used as a measurement that is assumed to be proportional to engine power output, it is important that the measurement as closely as possible reflect the actual pressure of the air/fuel entering the engine cylinders. To accomplish this, a preferred embodiment places the first inlet manifold sensor 60 downstream of the throttle plate to avoid most intervening influences on air/fuel pressure prior to entering the cylinders.

A first throttle actuator 65 is connected to the first engine 15. More specifically, as is known to those skilled in the art, the throttle actuator is connected to a throttle plate (not shown) and opens and closes the throttle plate in response to a command from the ECM 40. In a preferred embodiment, the throttle actuator directly controls the power output of the engine by positioning the throttle plate. However, in some applications and in particular applications involving diesel engines, fuel delivery may not be controlled exclusively by a throttle actuator and typically will involve direct fuel injection by fuel injectors. These systems nevertheless would fall within the scope of the present invention.

Connected to the second engine 20 is a second inlet manifold pressure sensor 75 which produces a signal indicative of the inlet manifold air pressure of the second engine 20. Placement of the second inlet manifold pressure sensor 75 is important to proper functioning of the present invention. Since inlet manifold pressure is used as a measurement of power output, it is important that the sensor accurately measure the pressure of the air/fuel entering the engine cylinders. To accomplish this, a preferred embodiment places the second inlet manifold sensor 75 downstream of the throttle plate to avoid most intervening influences on air/fuel pressure prior to entering the cylinders.

A second throttle actuator 70 is also connected to the second engine 20. More specifically, as described above with respect to the first engine 15, the second throttle actuator 70 is connected to a throttle plate (not shown) and opens and closes the throttle plate in response to a command from a second electronic control module 80. In a preferred embodiment, the amount of fuel delivered to the engine is controlled as a function of the opening and closing the throttle plate. However, in some other applications, fuel delivery may also be controlled by fuel injectors.

In a preferred embodiment the first engine 15 is electronically controlled by a first electronic control module 40 and the second engine 20 is electronically controlled by a second electronic control module 80. Electronic control modules (hereinafter referred to as "ECMs") are well known in the art. Each electronically controlled engine has an ECM specifically configured and tailored for operation of that specific engine. The design of such control modules is well within the skill of someone with ordinary skill in the art of electronic engine controls. All of the inputs and outputs, and other control criteria of such controls are therefore not described in further detail herein, except as necessary to describe the functioning of the present invention. The specific control implemented by the first and second electronic control modules 40, 85 are described below with respect to the control block diagrams shown in FIGS. 3 and 4.

As shown in FIG. 1, the first ECM 40 is electrically connected to a first generator control panel 50, which typically produces system level, low band width, control parameters, such as a desired engine speed, which are sent to the ECM 40. Such control panels are commercially available devices. The control panel used in a preferred embodiment of the present invention is the Engine Supervisory System Panel, manufactured by Caterpillar Inc., of Peoria, Ill. However, other known control panels could be used in connection with the invention described and claimed herein.

In addition to receiving signals from the first control panel 50, the ECM 40 will also monitor engine operation and will send information to the control panel 50. For example, in connection with an embodiment of the present invention, the ECM 40 is electrically connected to the engine speed sensor 55 and receives the engine speed signal. The ECM 40 is also electrically connected to the first inlet manifold air pressure sensor 60 and receives the first inlet manifold air pressure signal. The first ECM 40 is also electrically connected to a first throttle actuator 65. As is described in complete detail following, the first ECM 40 produces a throttle actuator signal on connector 41 which is delivered to the first throttle actuator 65, to thereby control fuel delivery to the first engine 15. The first ECM 40 also transmits the throttle actuator signal to the second ECM 80 which is then used to develop a throttle actuator command for the second throttle actuator 70. The throttle actuator signal is transmitted through the first control panel 50, the interface connector 51 (also shown in FIG. 2), the second control panel 85, and the second ECM 80.

As shown in FIG. 1, the second engine 20 is connected to and controlled by a second ECM 80. The second ECM 80 receives inputs from the second inlet manifold pressure sensor 75 and other engine sensors. The second ECM 80 communicates with a second control panel 85. The first and second control panels 50, 85 are operator interfaces that permit an operator to have control over the gen-set and are connected by an interface connector 51. Although the interface connector 51 is shown as a single connector, it should be recognized that these and other connectors illustrated in FIG. 1 may include connections for multiple signals. For example, FIG. 2 illustrates in greater detail typical signals communicated between the first and second control panels 50, 85 over the interface connection 51 in a preferred embodiment of the invention.

Figure 2:
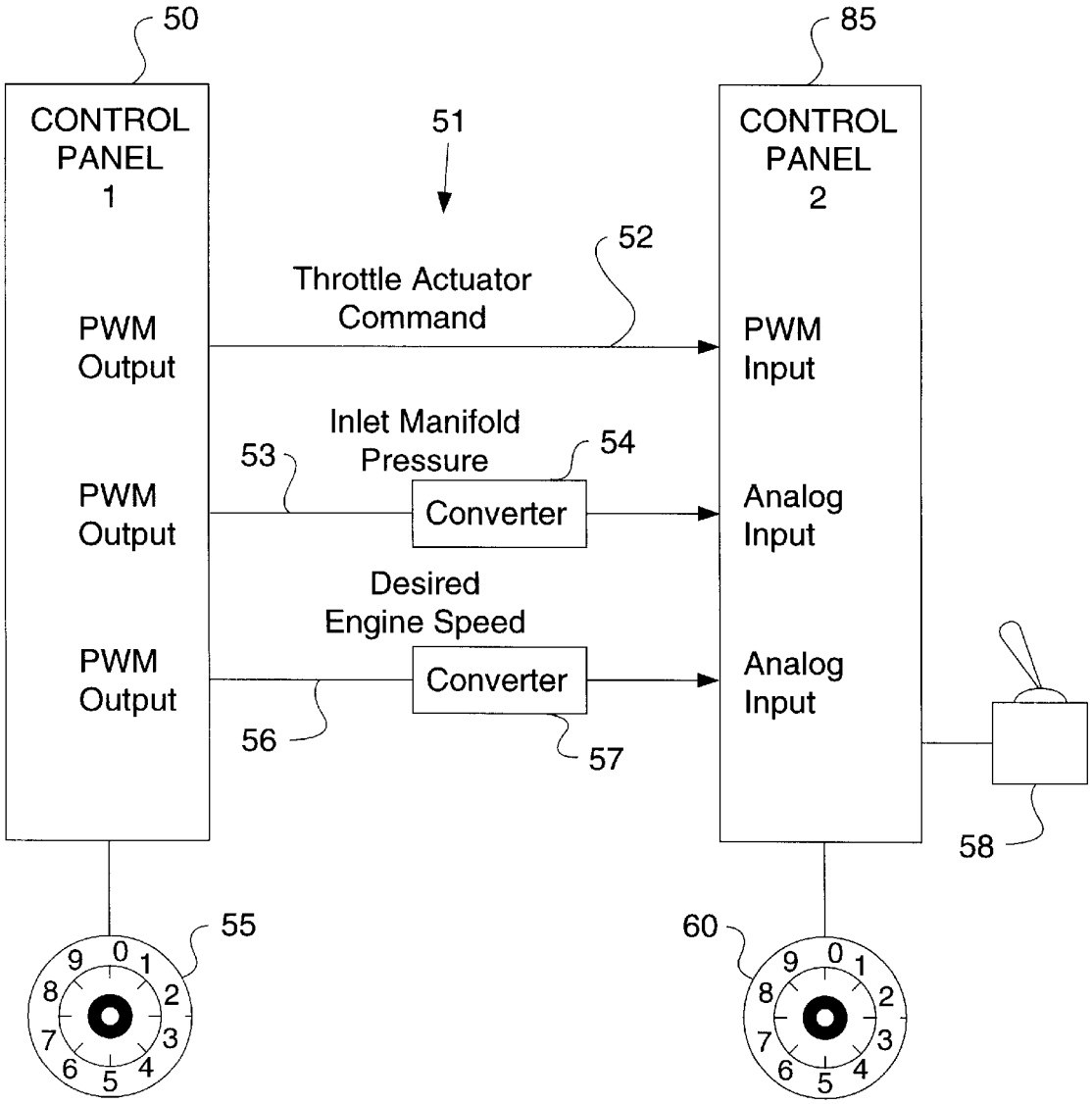
FIG. 2 shows a block diagram of a preferred embodiment of the interface connection and control panels of the present invention.

Referring now to FIG. 2, exemplary signals sent over the interface connection 51 between the first control panel 50 and the second control panel 85 are shown. Although the preferred embodiment uses discrete connections for each signal, alternative embodiments might use a single serial communication line or other form of communication without deviating from the scope of the present invention. The throttle actuator command signal 52, developed by the first ECM 40, is delivered to the second control panel 85. As shown in the figure, the signal is typically sent in the form of a pulse width modulated signal to reduce the likelihood of degradation from noise. As described above, the first inlet manifold pressure sensor 60 produces a signal indicative of the inlet manifold air pressure of the first engine 15. As shown in the figure, the signal 53 produced by the first inlet manifold pressure sensor 60 is transmitted from the first control panel 50 to a converter 54, which converts the pulse width modulated signal to an analog signal, and to the second control panel 85. A potentiometer 55 is preferably connected to the first control panel 50 and is manipulated by the operator to produce a desired engine speed signal. As shown in the figure, the desired engine speed signal 56 is transmitted from the first control panel 50 to a converter 57, which converts the pulse width modulated signal to an analog signal, and then to the second control panel 85. Although a potentiometer 55 is used in connection with a preferred embodiment, other devices capable of permitting the operator to select a desired engine speed may be used without deviating from the scope of the present invention. Connected to the second control panel 85 is a switch 58 having a manual position and an automatic position. As is describe more fully below, the switch 58 determines whether load balancing between the engines 15,20 is performed manually or automatically. Connected to the second control panel 85 is an offset potentiometer 60 which is used by the operator to manually adjust a throttle offset from the throttle actuator command 52 when the system is in manual mode. The same offset potentiometer 60 is also used as an inlet air pressure offset adjustment when operating in an automatic mode. Operation of the system in these modes is described more fully below in connection with the description of FIGS. 3 and 4. Although a potentiometer is used in connection with a preferred embodiment, other input devices could be readily and easily used without deviating from the scope of the present invention as defined by the appended claims. Furthermore, although the preferred embodiment is described in connection with a first and second ECM 40, 80 and a first and second control panel 50, 85 in the preferred embodiment, the ECM is physically located within the control panel. The description of the two components here as two separate blocks was to assist in understanding. However, in some applications, the ECM and the control panels may be discrete components without deviating from the scope of the present invention.

Figure 3:
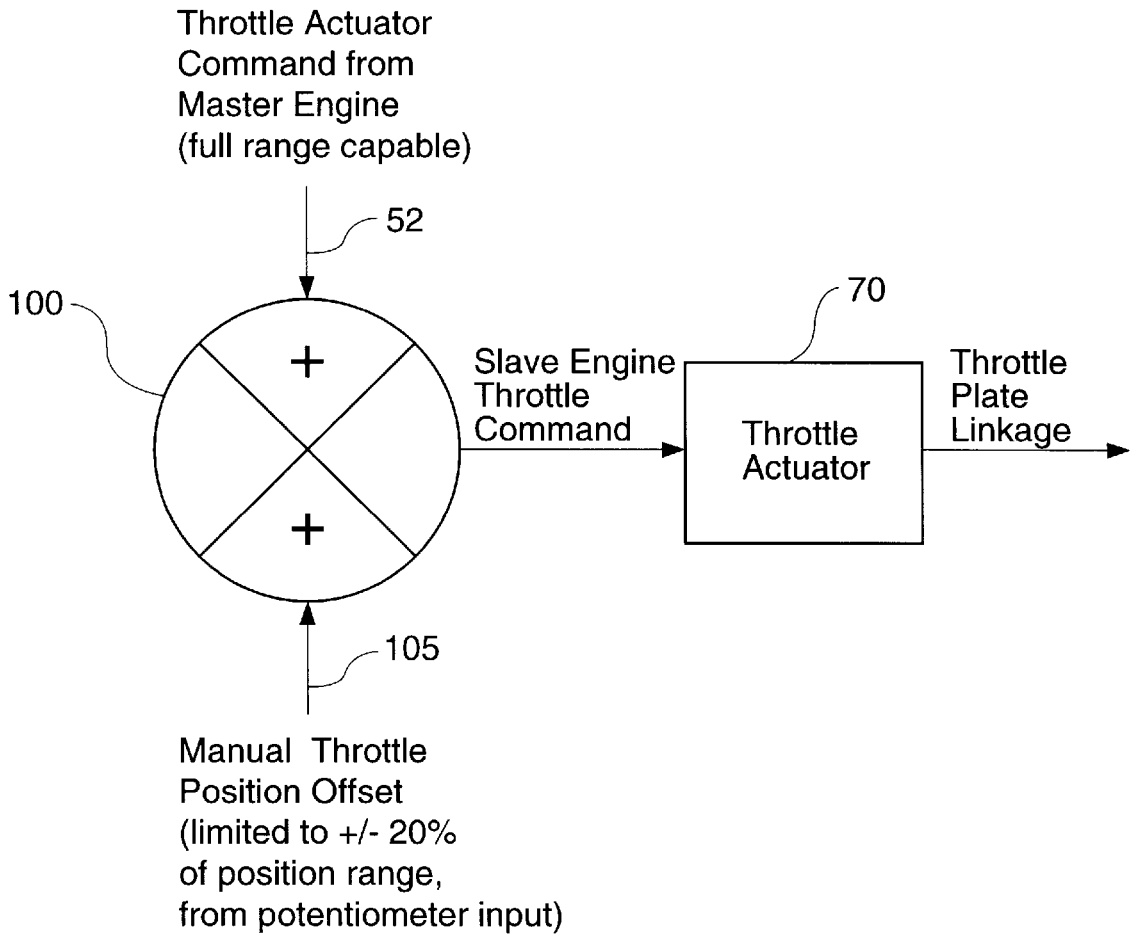
FIG. 3 shows a control diagram of the preferred embodiment of the control when operating in manual mode.

Referring now to FIG. 3, a block diagram of a preferred embodiment of the control of the present invention is shown when the switch 58 is in the manual position and the system is therefore in manual mode. By placing the switch in the manual position, the operator is permitted to manually adjust the throttle offset to the second engine 20 to balance the power output with the first engine 15. Typically the operator will balance the power output by physically connecting a separate service tool to the engines and then manipulating the throttle offset adjustment through the potentiometer 60 to obtain balanced power. FIG. 3 shows that the throttle actuator command 52 and the manual throttle position offset 105 produced by the manual throttle position offset potentiometer 60 (when the switch 58 is in the manual position) both enter the summing junction 100. The output of the summing junction 100 is the command signal produced by the second ECM 80 and received by the second throttle actuator 70 to control the position of the throttle linkage and thereby control fuel delivery to, and power output of, the second engine 20.

Figure 4:
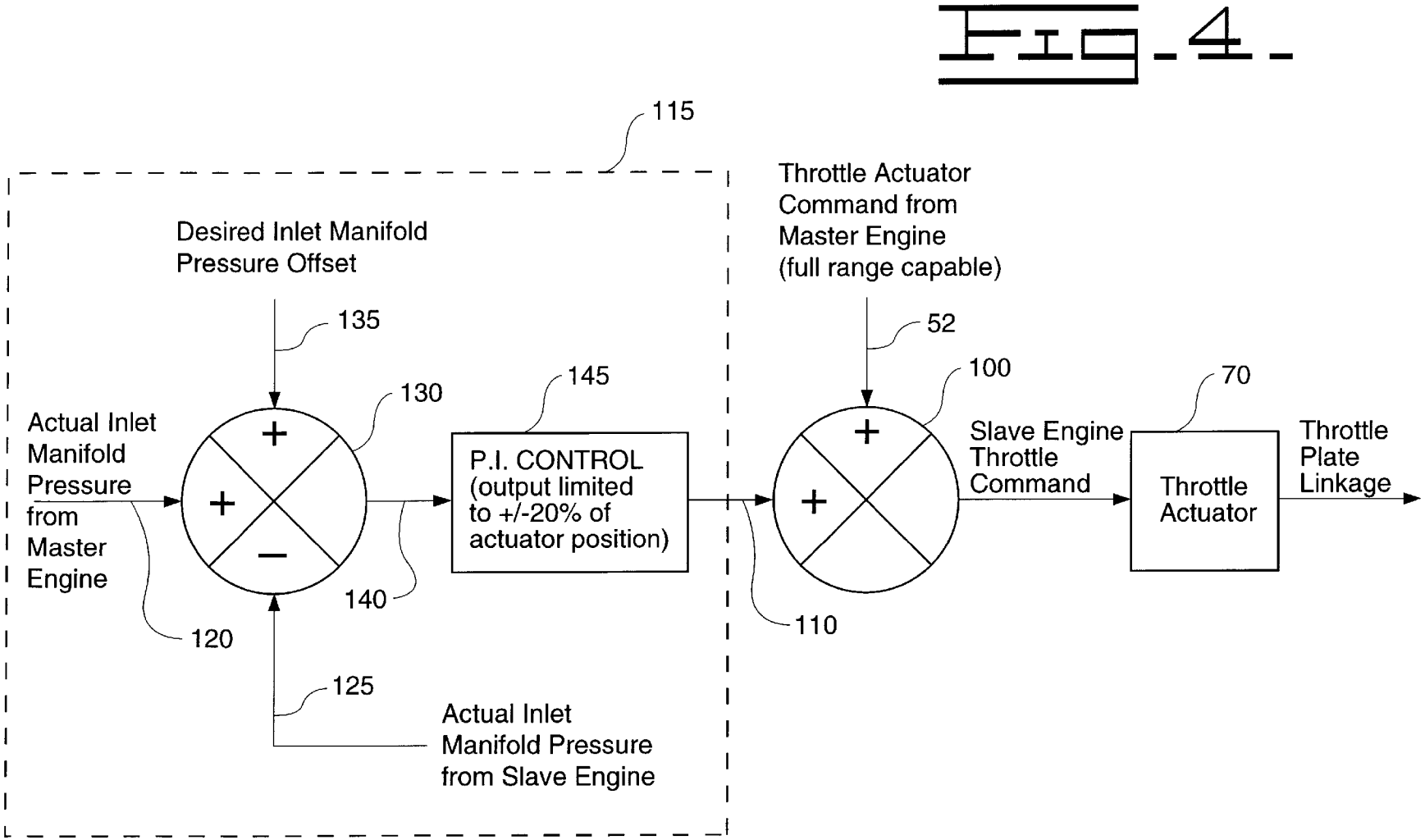
FIG. 4 shows a control diagram of the preferred embodiment of the control when operating in automatic mode.

Referring now to FIG. 4, a block diagram of a preferred embodiment of the control of the present invention is shown when the switch 58 is in the automatic position. As shown in the figure, when the switch is in the automatic position the manual throttle position offset 105 is replaced by a signal 110 produced by the control block 115. The throttle actuator command 52 and the signal 110 enter the summing junction 100, and as in the case of FIG. 3 illustrating manual adjustment, the output of the summing junction 100 is the command signal produced by the second ECM 80 and received by the second throttle actuator 70 to control the position of the throttle plate and thereby control fuel delivery to, and power output of, the second engine 20. Block 115 includes a form of closed loop inlet manifold pressure control which creates the throttle adjustment signal 110. The block 115 includes a summing junction 130, which sums the signal 120 from the first inlet manifold pressure sensor 60 and the desired inlet manifold pressure offset 135 produced by the offset potentiometer 60 when the switch 58 is in the automatic position. The signal 125 from the second inlet pressure sensor 75 is a negative input to the summing junction 130. Thus the output of the summing junction is a desired inlet manifold pressure offset error 140 which, in a preferred embodiment, is an input to a standard proportional-integral ("PI") controller 145. The PI controller output is then limited in the preferred embodiment to twenty percent of the throttle actuator position. The output of the PI controller 145 is an input signal 110 into summing junction 100. Although the preferred embodiment uses a PI controller, there are many other types of controllers that could be used in connection with the present invention. For example, in some applications, a PID controller or a lead-lag controller might be appropriate. Implementing such controls would be within the skill of a person of ordinary skill in the art.

By using a closed loop control around the desired inlet manifold pressure offset, the present invention can automatically better maintain balanced power output between the first engine 15 and the second engine 20.

We claim:

1. An apparatus for controlling power output of a first and second engine each having a power output, the output of said first and second engine being connected to a load, said apparatus comprising:

an electronic control module electrically connected to said first engine;

a first throttle actuator installed on said first engine;

a second throttle actuator installed on said second engine;

an engine speed sensor connected to said first engine and producing an engine speed signal;

a first inlet manifold pressure sensor installed in said first engine and producing a first inlet manifold pressure signal;

a second manifold pressure sensor installed in said second engine and producing a second inlet manifold pressure signal; and wherein said engine control module receives said engine speed signal and produces an engine speed error signal in response to a difference between said engine speed signal and a desired engine speed signal, said engine control module produces first and second throttle actuator signals in response to said engine speed error signal, said first throttle actuator signal controlling said first throttle actuator and said second throttle actuator signal controlling said second throttle actuator.

2. The apparatus according to claim 1, wherein:

said engine control module receives said first and second inlet manifold pressure signals and produces an inlet air pressure error signal; and said engine control module modifies said second throttle actuator signal in response to said inlet air pressure error signal.

3. The apparatus according to claim 2, including:

desired speed selecting means connected to said engine control module, said desired speed selecting means producing the desired engine speed signal.

4. The apparatus according to claim 3, including:

a switch having a manual and an automatic position, said switch electrically connected to said engine control module;

a manual throttle offset means connected to said engine control manual, said manual offset means producing a manual offset signal;

wherein said engine control module modifies said second actuator control signal in response to said manual offset signal and said switch being in said manual position.

5. A method of controlling a first and second engine driving a load, said method comprising:

producing an engine speed error signal in response to a difference between an actual and desired engine speed of said first engine;

producing an inlet air pressure error signal in response to a difference between the inlet air pressure of said first engine and the inlet air pressure of said second engine;

controlling fuel delivery to said second engine in response to said engine speed error signal and said inlet air pressure error signal.

6. An apparatus for controlling power output of a first and second engine connected to a load, said apparatus comprising:

an electronic control module electrically connected to said first engine, said electronic control module having stored therein a fuel delivery map as function of desired engine speed and actual engine speed;

a fuel injector installed in said first engine;

a fuel injector installed in said second engine;

an engine speed sensor connected to said first engine and producing an engine speed signal; and wherein said electronic control module receives said engine speed signal and produces an engine speed error signal in response to a difference between said engine speed signal and a desired engine speed signal, said engine control module produces first and second fuel delivery commands in response to said engine speed error signal, said first fuel delivery command determining the amount of fuel delivered by said first fuel injector and said second fuel delivery command determining the amount of fuel delivered by said second fuel injector.

* * * * *